United States Patent [19]

Shepherd

[11] Patent Number: 5,000,061

[45] Date of Patent: Mar. 19, 1991

[54] DRESSING APPARATUS FOR GRINDING WHEELS

[76] Inventor: James E. Shepherd, P.O. Box 2719, White City, Oreg. 97503

[21] Appl. No.: 549,951

[22] Filed: Jul. 9, 1990

[51] Int. Cl.[5] ..... B23D 63/00; B24B 53/02

[52] U.S. Cl. ..... 76/37; 51/5 D

[58] Field of Search ..... 76/37, 40, 41, 42, 43, 76/80.5; 51/5 D

*Primary Examiner*—Roscoe V. Parker, Jr.

*Attorney, Agent, or Firm*—Eugene M. Eckelman

[57] ABSTRACT

A base is arranged to be secured in a fixed position adjacent a grinding wheel of the type having a pair of grinding surfaces extending in different planes. A slide arm is mounted in the base and carries a single grinding wheel dressing tool with two positions. One such position is for grinding one of the wheel surfaces and the other position is for grinding the other wheel position. The structure and mounting of the dressing tool on the support is such that it is precisely positioned in each of its two positions for dressing the grinding surfaces.

8 Claims, 3 Drawing Sheets

DRESSING APPARATUS FOR GRINDING WHEELS

BACKGROUND OF THE INVENTION

This invention relates to new and useful improvements in grinding wheel dressing means and is particularly applicable to dressing means for saw chain grinding wheels.

A saw chain extensively in use employs chisel bit type cutter elements. These cutter elements have angled cutting surfaces that are ground by a grinding wheel properly shaped so as to have a pair of grinding surfaces extending in top and edge tapered planes. The most efficient angle of the cutting surfaces of a saw chain is predetermined, and to maintain such efficiency, these angles must remain constant as the wheel wears to a smaller diameter. If the wheel is dressed too thin, the side plate of the tooth will be ground too thin which does not leave clearance for the wood chips to be removed whereby the chain will bind in the cut. If the wheel is dressed too thick, the side plate of the tooth will be ground out too much and does not leave the portion of the tooth, namely, the gullet, that holds the tooth upright and keeps it from trying to lay over in the cut. The gullet guides the tooth through the wood.

In my U.S. Pat. No. 4,903,553, dressing apparatus for a grinding wheel is provided that maintains a consistent shape of the grinding wheel surfaces as the wheel is dressed and reduced in size and comprises a substantial improvement over other dressing means which employ individual dressing heads that are operated simply by sight. In accomplishing this improvement, dressing apparatus for a grinding wheel is provided that employs a pair of grinding wheel dressing means both mounted on a single adjustable support whereby the pair of dresser means are maintained in their selected dressing planes as support means is adjusted for wheel wear.

SUMMARY OF THE INVENTION

According to the present invention and forming a primary objective thereof, dressing apparatus is provided somewhat similar to the apparatus of my U.S. Pat. No. 4,903,553 in that the dressing means is mounted on a single adjustable support. However, the present structure reduces the number of parts to a minimum and thus is more simplified and more economical to manufacture.

A more particular object is to provide dressing apparatus for a grinding wheel that employs a single dressing head which is adjustable on support means whereby the same dressing head is moved to a first position to dress one of the grinding surfaces of the grinding wheel and then moved to a second position to dress the other of the grinding surfaces.

In carrying out the objectives of the invention, the dressing apparatus includes holder means arranged to be secured in a fixed position adjacent the grinding wheel. The holder means can be repositioned relative to the grinding wheel as the latter wears and requires dressing. Support means support a dressing tool on the holder means and provide two dressing positions for the dressing tool whereby the latter is arranged to be moved to a first position to dress one of the grinding surfaces of the grinding wheel and then moved to a second position to dress the other grinding surface. The holder means and the adjustability thereof maintain the single dressing tool in proper position for maintaining proper dressing of the grinding surfaces of the wheel as the wheel wears.

The invention will be better understood and additional objects and advantages will become apparent from the following description taken in connection with the accompanying drawings.

DETAILED DESCRIPTION OF A PREFERRED EMBODIMENT

Figure 3:
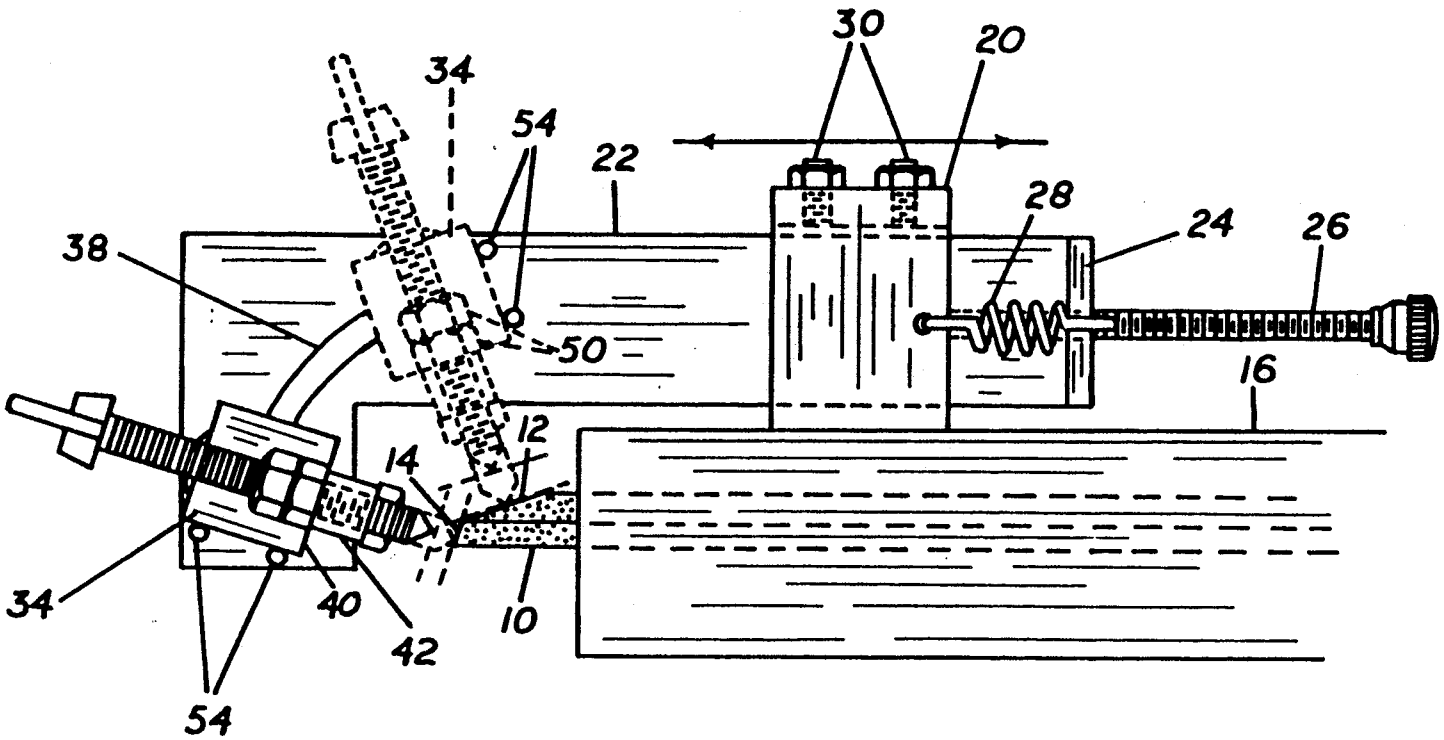
FIG. 3 is a side elevational view.

With reference to the drawings, the present dressing apparatus is particularly applicable to the dressing of a saw chain grinding wheel 10. This type of grinding wheel is disc-like in shape and has a pair of saw chain sharpening surfaces 12 and 14 adjacent its outer edge which extend in different planes. Surface 12 comprises a tapered top surface and surface 14 comprises a tapered edge surface, and the combination of these two surfaces of the shape shown particularly in FIG. 3 provide proper sharpening of a chisel bit type cutter element of saw chains. As stated hereinbefore, maintaining the precise ground relationship of these two surfaces as the wheel wears and is redressed is important. Grinding wheel 10 in conventional structure is associated with a support housing 16 suitably mounted on a stand or other base, not shown, of conventional construction.

According to the invention, a base portion 20 is securely anchored, as by welding, to the support housing 16 for the grinding wheel. Base portion 20 preferably is mounted on the top of the grinding wheel housing 16 and is offset to one side of the longitudinal center of the grinding wheel for supporting a slide arm or holder 22 for longitudinal movement. The rearward end of slide arm 22 has a flange 24 that threadedly supports a longitudinally disposed adjusting screw 26 having its forward end abutted against the base portion 20. The slide arm is urged forwardly for abutment of the adjusting screw 26 against the base portion 20 by a tension spring 28 connected between the flange 24 and the base portion.

Slide arm 22 is maintained in a fixed but longitudinally adjustable position by cooperating interaction of the adjusting screw 26 and tension spring 28. Slack adjusting screws 30 may be employed in the base portion to remove any unwanted slack in the slidable support of the slide arm.

Slide arm 22 supports a single dressing head 34 that has movable support on the arm between a pair of preselected positions providing for grinding the surfaces 12 and 14. The head 34 has a mounting bolt 36 that projects through an arcuate slot 38 in the arm 22 and of a segmental length that allows the dressing head to be properly located in its two positios, as will be set forth in greater detail hereinafter.

Head 34 has an end surface 40 that forms a pivotal guide surface for a laterally projecting lever 42 having a threadedly mounted diamond dressing tool 44 supported on it at right angles to the surface 40. Lever 42 has a pivot support 46 at its inner end on the surface 40 of head 34, this pivotal mounting and support of the lever 42 on the surface 40 allowing swinging dressing movement of the tool 44 between full and broken line positions shown in FIGS. 1 and 2 and indicated by arrow 48. Dressing tool 44 is adjustable axially for wear by the threaded support thereof on the dressing arm. It is releasably locked in position by lock nuts 50.

Figure 1:
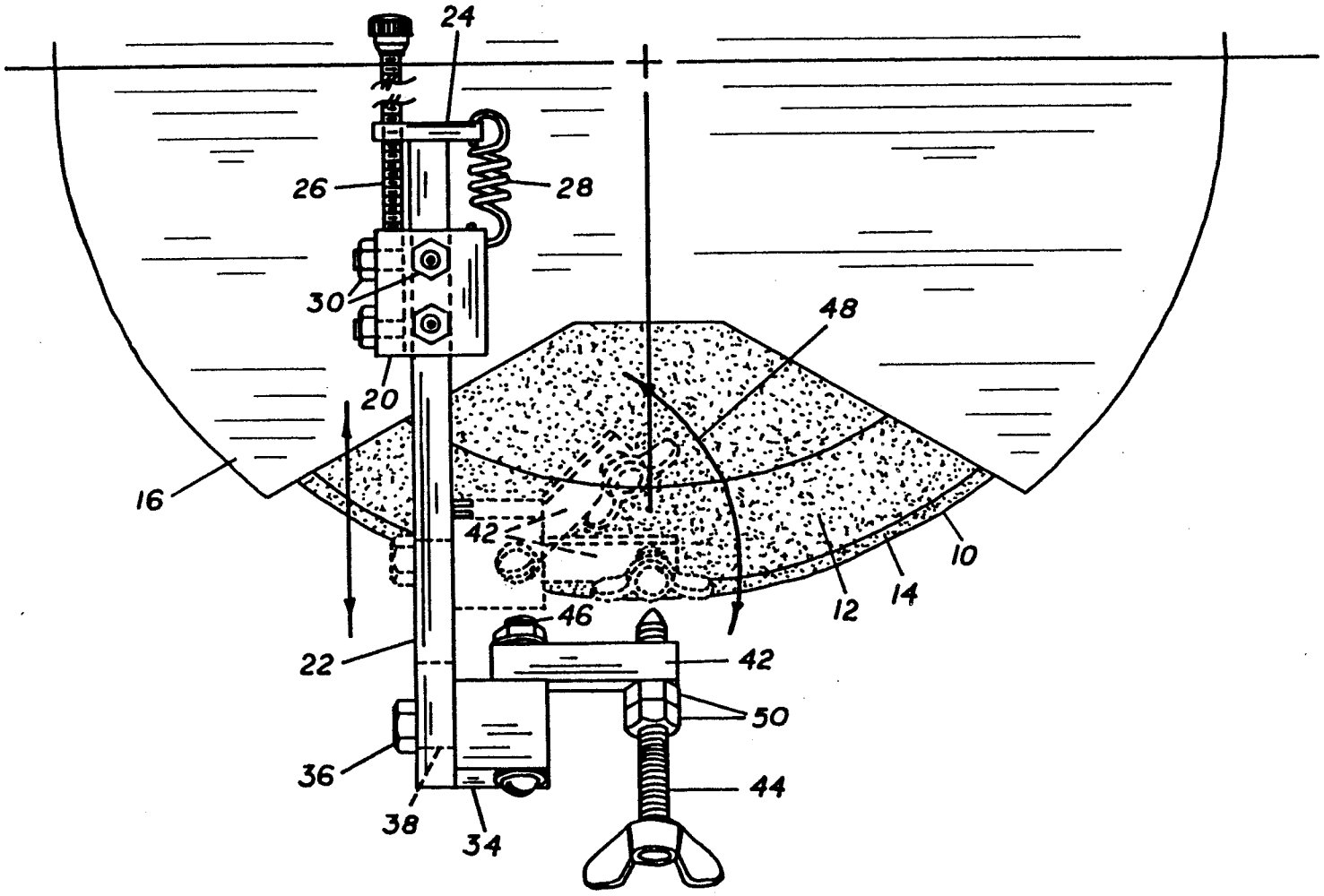
FIG. 1 is a top plan view of the dressing apparatus of the present invention.
Figure 2:
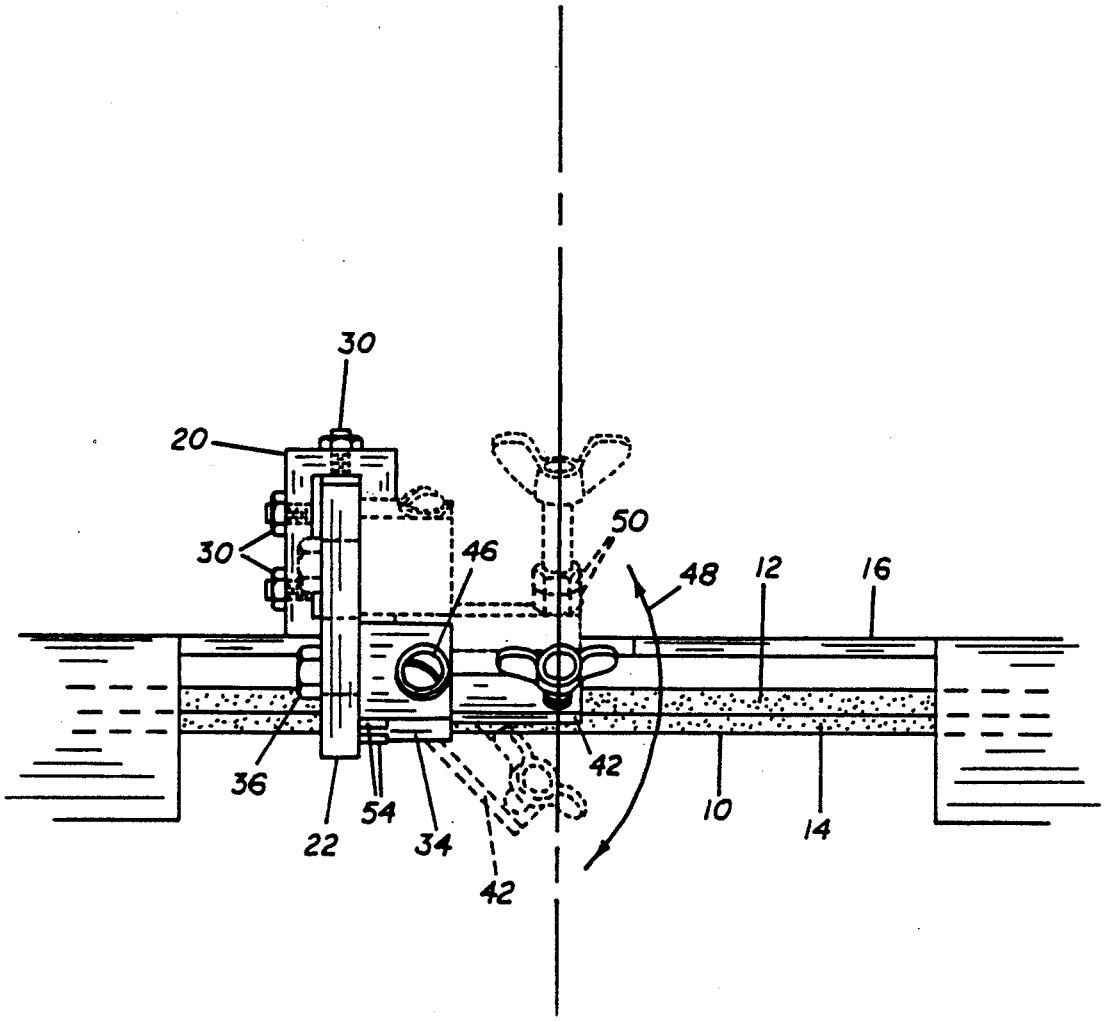
FIG. 2 is a front elevational view of the dressing apparatus.

The dressing tool 44 is supported at approximately the front center of the grinding wheel as seen in FIG. 1. The head 34 and arcuate slot 38 are preselected in construction and arrangement such that the end surface 40 that guides the lever arm 42 in its swinging movement will be in parallel relation with grinding wheel surface 12 when the head is in the up or dotted line position of FIG. 3 and will be in parallel relation with the grinding wheel surface 14 when the head is in its lower or full line position. Also, the dressing tool 44 is supported at right angles to the surface 40 by the lever 42 whereby when the latter is swung in an arc on its pivot in guided engagement along surface 40, the end of tool 44 will dress the wheel in a plane parallel with surface 40. Pairs of aligning pins 54, FIGS. 2 and 3, are provided on the arm 22 at end positions of the head whereby to provide stops for the head in precise grinding positions and also to stabilize and align the surface 40 in parallel relating with the surfaces 12 or 14 to be dressed.

In a dressing operation, proper longitudinal positioning of the slide arm 22 is accomplished by the adjusting screw 26. A first one of surfaces 12 or 14 is dressed by unlocking mounting bolt 36 and then moving the head 34 in the slot 38 to a first end position against the aligning pins at that end. The mounting bolt is then locked and the lever 42, after proper positioning of the tool 44 in the lever, is swung on its pivot in guided relation on the surface 40 to move the tool in its dressing engagement against the grinding wheel surface being dressed. When this surface has been dressed, the mounting bolt is unlocked and the head moved in the slot to the other end in engagement with the other aligning pins 54. The mounting bolt is again tightened and the second surface of the grinding wheel dressed by swinging the lever 42 on its pivot in guided relation against the surface to be dressed.

As the wheel wears, adjusting screw 26 is threadedly adjusted inwardly to retract the slide arm for the amount of wheel wear. Since the dressing head moves with the slide arm 22, a consistent grinding wheel shape will be maintained every time that the wheel is dressed. This then provides efficient grinding of a chisel bit type saw chain. Since both surfaces can be dressed with a single but adjustable dressing head, the structure is substantially simplified in that less machine parts are involved in manufacture and only one diamond dressing tool is necessary.

It is to be understood that a reversal of parts is within the concept of the invention, namely, the arm 22 and supporting structure for the diamond tool could be a part of the base and the grinding wheel assembly moved relative thereto to compensate for wheel wear.

Having thus described my invention, I claim:

1. Dressing apparatus for a grinding wheel of the disc-type having a peripheral portion including a pair of grinding surfaces extending in different planes, said apparatus comprising:

holder means arranged to be mounted adjacent a grinding wheel, lever means mounted on said holder means, means connected between said holder means and the grinding wheel providing relative positioning movement of said holder means and the grinding wheel as the latter wears and requires dressing, grinding wheel dressing means on said lever means, and support means supporting said lever means on said holder means, said support means providing two dressing positions for said grinding wheel dressing means whereby the latter is arranged to be moved to a first position to dress one of the grinding surfaces of the grinding wheel and then moved to a second position to dress the other grinding surface.

2. The dressing apparatus of claim 1 wherein said support means includes arcuate positioning means for said lever means along which the latter is arranged to be positioned and secured in its said two positions.

3. The dressing apparatus of claim 1 wherein said support means includes a head portion and arcuate positioning means for said head portion whereby said grinding wheel dressing means is arranged to be positioned and secured in its said two dressing positions.

4. The dressing apparatus of claim 3 wherein said head portion is held on said support means by a clamping pivot shaft having a clamped position holding said head portion in a selected angular dressing position and a released position for pivoting said head portion to another selected dressing position.

5. The dressing apparatus of claim 3 wherein said head portion includes a support surface, said lever means having movement along said surface, a dressing tool supported on said lever means at right angles to said support surface, said support means including a clamping pivot shaft connection that holds said head portion in its dressing positions with said support surface thereof parallel with a grinding surface of the grinding wheel.

6. The dressing apparatus for a grinding wheel of the disc-type having a peripheral portion including a pair of grinding surfaces extending in different planes, said apparatus comprising:

holder means arranged to be secured in a fixed position adjacent the grinding wheel, grinding wheel dressing means including a single head supported by said holder means, said holder means providing two dressing positions for said head whereby the latter is arranged to be moved to a first position to dress one of the grinding surfaces of the grinding wheel and then moved to a second position to dress the other of the grinding surfaces.

7. The dressing apparatus of claim 6 wherein said holder means includes an arcuate mounting slot for said head along which the latter is arranged to be positioned and secured in its said two positions.

8. The dressing apparatus of claim 6 wherein said holder means includes an arcuate mounting slot for said head along which the latter is arranged to be positioned and secured in its said two positions, and abutment pins adjacent each end of said slot providing stop and aligning functions for said dressing means.

* * * * *